US006653764B2

(12) United States Patent
Kato et al.

(10) Patent No.: US 6,653,764 B2
(45) Date of Patent: Nov. 25, 2003

(54) DISCHARGE BULB AND METHOD OF MANUFACTURING THE SAME

(75) Inventors: Ken Kato, Shizuoka (JP); Takahiro Iwai, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/287,703

(22) Filed: Nov. 5, 2002

(65) Prior Publication Data

US 2003/0090189 A1 May 15, 2003

(30) Foreign Application Priority Data

Nov. 9, 2001 (JP) ..... P.2001-345449

(51) Int. Cl.[7] ..... H01J 1/02

(52) U.S. Cl. ..... 313/25; 313/318.01; 313/318.02; 313/318.1

(58) Field of Search ..... 313/318.01, 318.02, 313/318.09, 318.1, 25

(56) References Cited

U.S. PATENT DOCUMENTS 5,386,173 A * 1/1995 Kosmatka ..... 313/318.01

5,757,110 A * 5/1998 Motiduki et al. ..... 313/25

FOREIGN PATENT DOCUMENTS

| | | |
|---|---|---|
| JP | 8-162007 | 6/1996 |
| JP | 11-176319 | 7/1999 |

* cited by examiner

*Primary Examiner*—Sandra O'Shea
*Assistant Examiner*—Sumati Krishnan
(74) *Attorney, Agent, or Firm*—Sughrue Mion, PLLC

(57) ABSTRACT

A base end 12*a* of an arc tube unit 12 is inserted in a glass tube 50 which is previously fixed to an insulating plug unit 14, and a shroud tube 18 and the glass tube 50 are then bonded and fixed to each other in such a state that an amount of insertion of the arc tube unit 12 is regulated in order to set a dimension L between an optical reference plane Po of the insulating plug unit 14 and the tip position of a bar-shaped electrode 26B of an arc tube 16 to be a predetermined set dimension Lo. Consequently, the arc tube unit 12 can be fixed and supported on the insulating plug unit 14 with a simple structure in a simple process, and furthermore, it is possible to eliminate a possibility that the shroud tube 18 might be damaged, for example, broken by the fastening force of a metal band as in the conventional art.

3 Claims, 6 Drawing Sheets

DISCHARGE BULB AND METHOD OF MANUFACTURING THE SAME

BACKGROUND OF THE INVENTION

1. Field of the Invention

The present invention relates to a discharge bulb to be used in a headlamp for a vehicle and a method of manufacturing the discharge bulb.

2.Description of the Related Art

Since a discharge bulb can carry out high luminance irradiation, it has recently been used in a headlamp for a vehicle very often.

As described in Japanese laid open publication Hei 11-176319, for example, there has been known a discharge bulb to be used in a headlamp for a vehicle which comprises an arc tube unit 102 including an arc tube 104 and a shroud tube 106 cylindrically surrounding the arc tube 104, and a plug member 108 for fixing and supporting a base end 102*a* of the arc tube unit 102 as shown in FIG. 6.

In such a discharge bulb, it is optically important that a discharge light emitting section 104*a* of the arc tube 104 is provided with a predetermined positional relationship with an optical datum plane Po of the plug member 108. For this reason, the arc tube unit 102 is fixed and supported on the plug member 108 in the following manner.

More specifically, a metal band 110 is fastened and fixed to the shroud tube 106 on the base end 102*a* of the arc tube unit 102, and furthermore, a slider fixture 112 is welded to the metal band 110. In such a state that the slider fixture 112 is set into a predetermined jig (not shown), the metal band 110 is caused to slide with respect to the slider fixture 122, thereby carrying out a necessary position adjustment. Thus, the welding is carried out in such a state that the discharge light emitting section 104*a* of the arc tube 104 and the optical reference plane Po of the plug member 108 have a predetermined positional relationship. Then, the slider fixture 112 is caused to abut on a metallic base plate 114 which is previously fixed to the plug member 108 and both of them are thus welded to each other. Consequently, the arc tube unit 102 is fixed and supported on the plug member 108.

In the conventional discharge bulb, however, there is a problem in that a structure for fixing and supporting the arc tube unit 102 on the plug member 108 is complicated, and furthermore, a manufacturing process is also complicated.

In addition, the metal band 110 is to be tightly fastened and fixed to the shroud tube 106 so as not to be loosened easily. Therefore, there is a problem in that the shroud tube 106 is often damaged, for example, broken by the fastening force.

SUMMARY OF THE INVENTION

The invention has been made in consideration of the circumstances and has an object to provide a discharge bulb capable of fixing and supporting an arc tube unit to a plug member with a simple structure in a simple process without damaging, for example, breaking a shroud tube, and a method of manufacturing the discharge bulb.

The invention achieves the object by such a structure that the arc tube unit is fixed and supported on the plug member through a predetermined glass tube.

More specifically, the invention provides a discharge bulb comprising an arc tube unit including an arc tube and a shroud tube cylindrically surrounding the arc tube, and a plug member for fixing and supporting a base end of the arc tube unit, wherein a glass tube is fixed to the plug member, the base end of the arc tube unit is inserted in the glass tube and the shroud tube of the arc tube unit and the glass tube are bonded and fixed to each other.

Moreover, the invention provides a method of manufacturing a discharge bulb comprising an arc tube unit including an arc tube and a shroud tube cylindrically surrounding the arc tube, and a plug member for fixing and supporting a base end of the arc tube unit, comprising the steps of:

inserting the base end of the arc tube unit in a glass tube which is previously fixed to the plug member; and bonding and fixing the shroud tube and the glass tube to each other in such a state that an amount of insertion of the arc tube unit is regulated in order to set a dimension between an optical reference plane of the plug member and a predetermined position of a discharge light emitting section of the arc tube to be a predetermined set dimension.

If the "glass tube" in which the base end of the arc tube unit can be inserted and which can be bonded and fixed to the shroud tube is used, a specific structure such as a length, a sectional shape or a material is not particularly restricted. Moreover, the method of fixing the "glass tube" to the plug member is not particularly restricted.

If the "predetermined position of the discharge light emitting section" of the arc tube can be specified, a specific position thereof is not particularly restricted. For example, it is possible to employ a tip position of one of a pair of electrodes constituting the arc tube or a central position between a pair of electrodes.

DESCRIPTION OF THE PREFERRED EMBODIMENTS

An embodiment of the invention will be described below with reference to the drawings.

Figure 1:
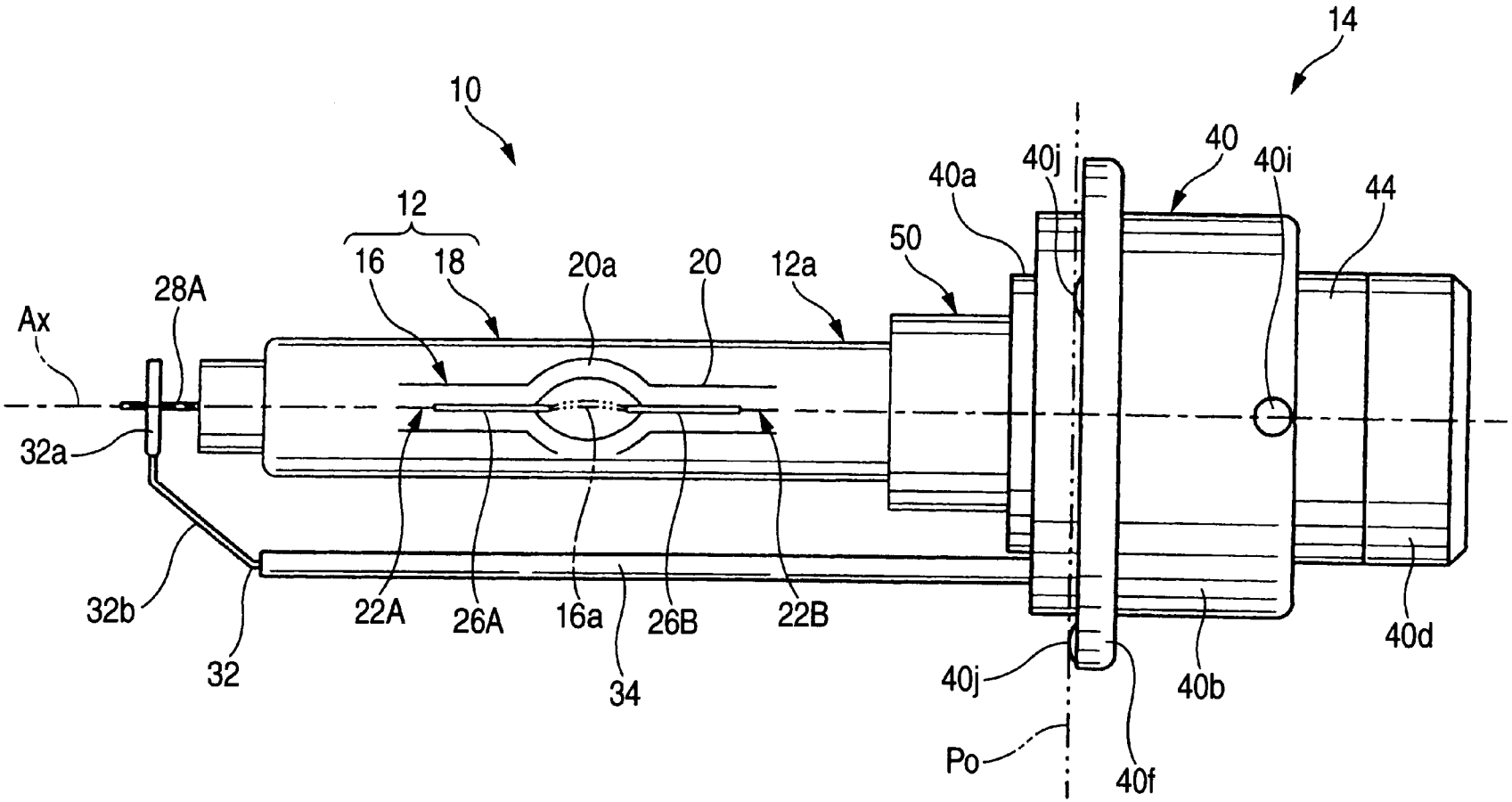
FIG. 1 is a side view showing a discharge bulb according to an embodiment of the invention.
Figure 2:
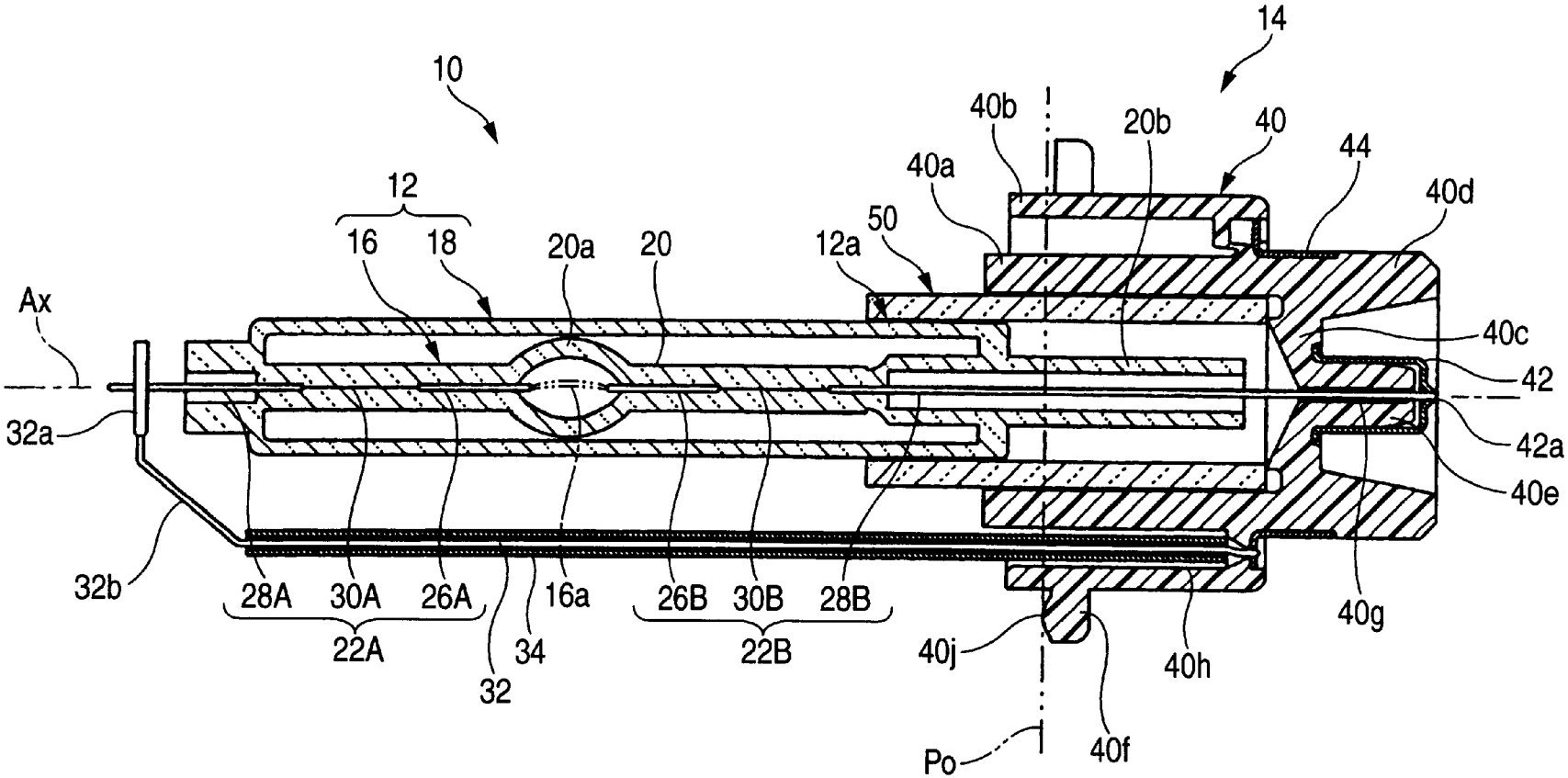
FIG. 2 is a sectional side view showing the discharge bulb, FIGS. 3(*a*) to 3(*c*) are the side views showing a step of assembling the discharge bulb, FIGS. 4(*a*) and 4(*b*) are the side views showing a step of regulating an amount of insertion of an arc tube unit for a glass tube in the assembling step, FIGS. 5(*a*) and 5(*b*) are side views showing the discharge bulb and a halogen bulb of an HB4 type which are arranged in order to explain a compatibility thereof, and FIG. 6 s a view showing a conventional example in the same manner as in FIG. 2.

FIGS. 1 and 2 are a side view and a sectional side view showing a discharge bulb 10 according to an embodiment of the invention.

As shown in these drawings, the discharge bulb 10 according to the embodiment comprises an arc tube unit 12 extended in a longitudinal direction along an optical axis Ax, and an insulating plug unit (a plug member) 14 for fixing and supporting a base end (a rear end) 12*a* of the arc tube unit 12 through a glass tube 50.

The arc tube unit 12 includes an arc tube 16 and a shroud tube 18 which cylindrically surrounds the arc tube 16.

The arc tube 16 includes an arc tube body 20 having an almost elliptical spherical luminous tube section 20*a* and formed of quartz glass, and a pair of electrode assies 22A and 22B which are pinch sealed with the arc tube body 20 on both sides of the luminous tube section 20*a*. On the other hand, the shroud tube 18 is constituted by a quartz glass tube doped with an ultraviolet absorbent and is welded to the arc tube body 20 on both ends in a longitudinal direction. A rear end 20*b* of the arc tube body 20 is cylindrically extended rearward from the welding position to the shroud tube 18.

The electrode assemblies 22A and 22B are respectively provided with bar-shaped electrodes 26A and 26B and lead wires 28A and 28B coupled and fixed to each other through metal foils 30A and 30B formed of a molybdenum foil, and the tip portions of the bar-shaped electrodes 26A and 26B are protruded from both side in a longitudinal direction in the luminous tube section 20*a*. By a high voltage applied between both of the bar-shaped electrodes 26A and 26B, a discharge light emitting section 16*a* is formed between the bar-shaped electrodes 26A and 26B. Each of the lead wires 28A and 28B is extended forward and rearward from the arc tube body 20.

The lead wire 28A on the front side is spot welded to a front end 32*a* of a lead wire 32 at a front end thereof. The lead wire 32 is extended in a longitudinal direction to be surrounded by a sleeve 34 formed of ceramics in the vicinity of a portion provided under the arc tube unit 12, and the front end 32*a* and a portion 32*b* in the vicinity of the front end are exposed from the sleeve 34. The front end 32*a* of the lead wire 32 is extended upward orthogonally to the lead wire 28A and the portion 32*b* in the vicinity of the front end is extended to be chamfered obliquely upward.

The insulating plug unit 14 includes an insulating plug 40 formed of an insulating material, a terminal cap 42 constituting the plus side terminal of the discharge bulb 10, and a contact ring 44 constituting the minus side terminal of the discharge bulb 10.

The insulating plug 40 includes an inner cylinder section 40*a*, an outer cylinder section 40*b* formed to be connected to the inner cylinder section 40*a* at a rear end, a diaphragm section 40*c* for blocking the rear end of the inner cylinder section 40*a*, a cylindrical flange section 40*d* extended rearward from the peripheral edge portion of the diaphragm section 40*c*, a boss section 40*e* protruded rearward from the central part of the diaphragm section 40*c*, and a ring section 40*f* formed on the outer peripheral surface of the outer cylinder section 40*b*.

A lead wire insertion hole 40*g* extended in a longitudinal direction is formed in the central part of the boss section 40*e*. The front face of the diaphragm section 40*c* is formed to be tapered toward the lead wire insertion hole 40*g*. An insertion hole 40*h* in which the rear ends of the lead wire 32 and the sleeve 34 are to be inserted is formed between the inner cylinder section 40*a* and the outer cylinder section 40*b* at the lower end of the insulating plug 40. A pair of left and right positioning pins 40*i* are formed at the rear end of the outer peripheral surface of the outer cylinder section 40*b*. Spherical projections 40*j* are formed in three circumferential portions at regular intervals on the front face of the ring section 40*f*, and the optical reference plane Po of the insulating plug unit 14 is constituted as to be a plane provided in contact with these three spherical projections 40*j*.

The terminal cap 42 is pressed and fixed into the boss section 40*e* of the insulating plug 40 from the back, an is laser welded to the lead wire 28B around the lead wire insertion hole 42*a* formed in a tip portion thereof. On the other hand, the contact ring 44 is fixed to the outer peripheral surface of the diaphragm section 40*c* of the insulting plug 40 and the rear end of the lead wire 32 is laser welded to the contact ring 44.

In the embodiment, the arc tube unit 12 is fixed and supported on the insulating plug unit 14 by inserting the base end 12*a* of the arc tube unit 12 into the glass tube 50 which is previously fixed to the insulating plug unit 14 and bonding and fixing the shroud tube 18 of the arc tube unit 12 to the glass tube 50.

The glass tube 50 is a cylindrical tube formed of aluminosilicate and has an outside diameter which is slightly smaller than the inside diameter of the cylinder section 40*a* of the insulating plug 40, and has an inside diameter which is slightly larger than the outside diameter of the shroud tube 18. The whole length of the glass tube 50 is set to have a dimension (a greater dimension by approximately 5 to 10 mm) which is somewhat longer than the depth (longitudinal length) of the inner cylinder section 40*a* of the insulating plug 40.

Figure 3:
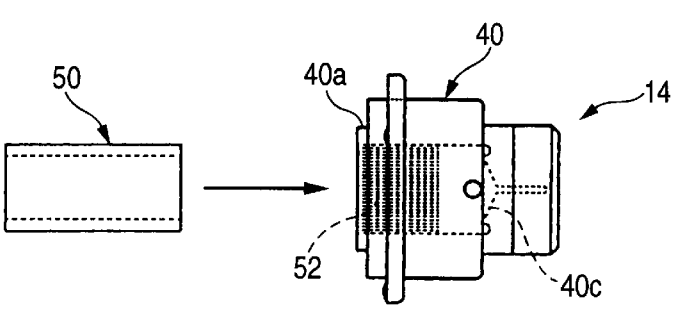
Figure 3:
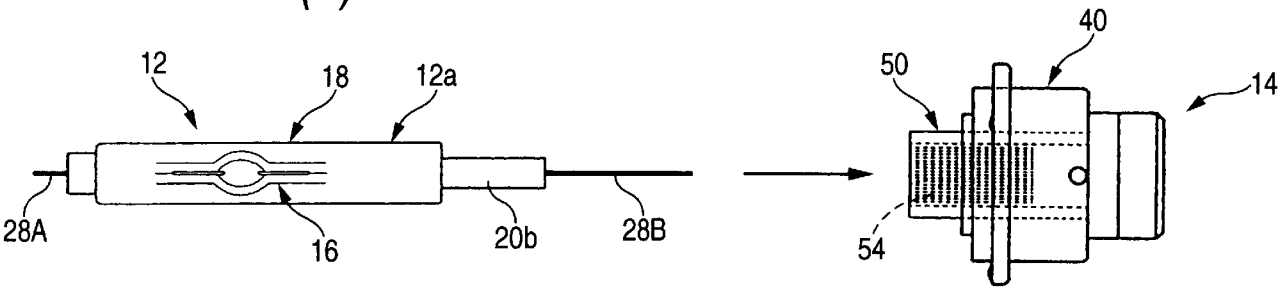
Figure 3:
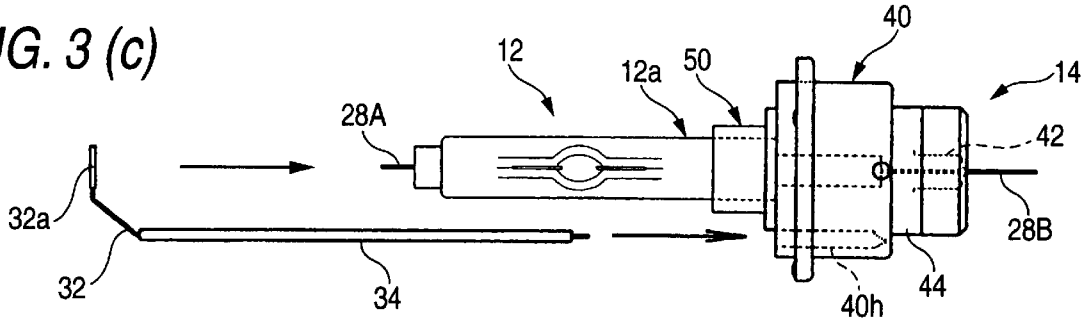

FIGS. 3(*a*) to 3(*c*) are the side views showing a step of assembling the discharge bulb 10 according to the embodiment.

As shown in FIG. 3(*a*), first of all, the glass tube 50 is previously bonded and fixed to the insulating plug unit 14. The boning and fixation is carried out by applying an adhesive 52 to the inner peripheral surface of the inner cylinder section 40*a* in the insulating plug 40 of the insulating plug unit 14 and then inserting the glass tube 50 in the inner cylinder section 40*a*. In that case, the rear end face of the glass tube 50 is caused to abut on the diaphragm section 40*c* of the insulating plug 40 such that the amount of forward protrusion of the glass tube 50 from the front end face of the inner cylinder section 40*a* always has a constant value.

As shown in FIG. 3(*b*), next, an adhesive 54 is applied to the inner peripheral surface of the glass tube 50 and the base end 12*a* of the arc tube unit 12 is then inserted into the glass tube 50 so that the shroud tube 18 is bonded and fixed to the glass tube 50. In that case, the amount of the insertion of the arc tube unit 12 in the glass tube 50 is regulated before the adhesive 54 is solidified (which will be described below).

As shown in FIG. 3(*c*), the rear ends of the lead wire 32 and the sleeve 34 are inserted in the insertion hole 40*h* of the insulating plug 40, thereby laser welding the rear end of the lead wire 32 to the contact ring 44 and spot welding the front end 32*a* of the lead wire 32 to the front end of the lead wire 28A. Moreover, the portion of the lead wire 28B which is protruded toward the rear side of the terminal cap 42 is cut away and the rear end is laser welded to the terminal cap 42. Consequently, the discharge bulb 10 is completely assembled.

Figure 4:
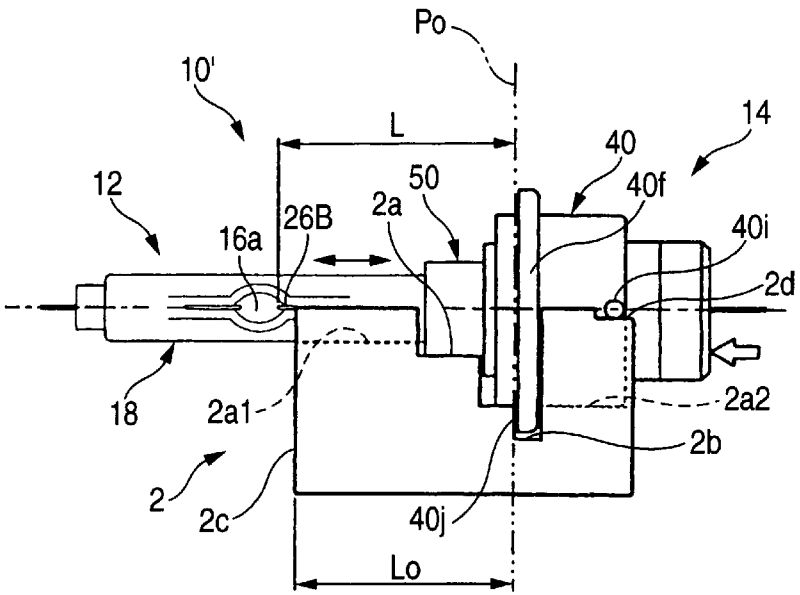
Figure 4:
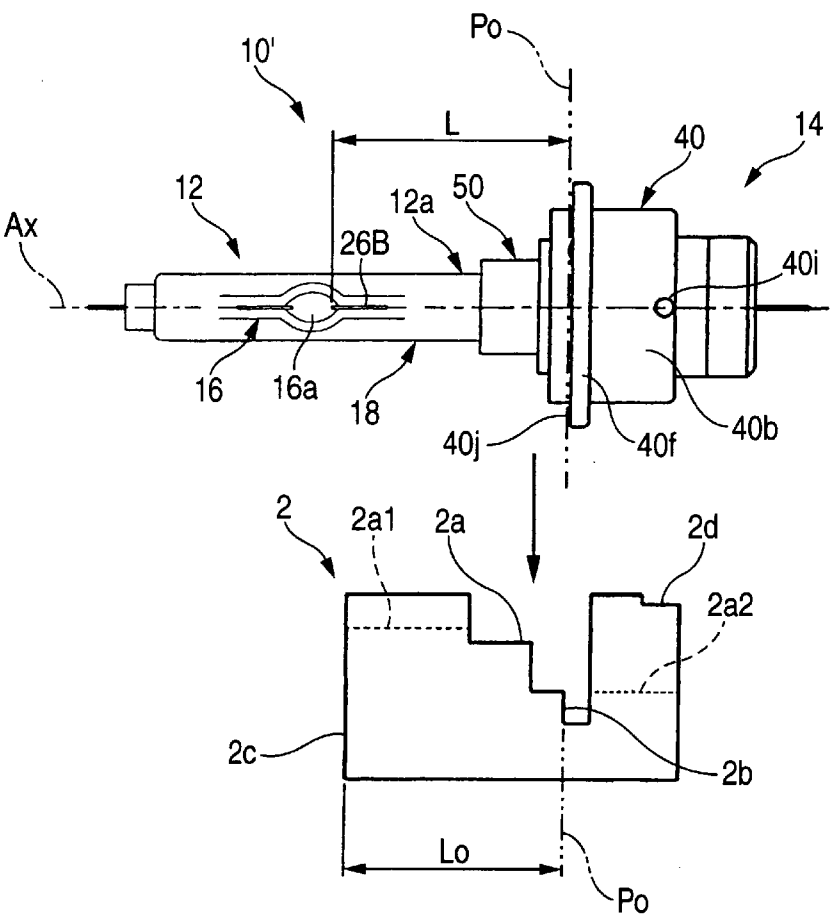

FIGS. 4(*a*) and 4(*b*) are the side views showing a step of regulating the amount of the insertion of the arc tube unit 12 in the glass tube 50 at the assembling step. The amount of the insertion is regulated by using the insertion amount regulating jig 2 shown in the drawing.

The insertion amount regulating jig 2 has an upper end face 2*a* set to have an almost identical side sectional shape to the side projection shapes of the arc tube unit 12, the glass tube 50 and the insulating plug unit 14. The portion of the upper end face 2*a* corresponding to the shroud tube 18 is formed to be a semicylindrical concave section 2*a*1 having the same shape as that of the outer peripheral surface of the shroud tube 18, and furthermore, the portion of the upper end face 2*a* corresponding to the insulating plug 40 is formed to be a semicylindrical concave section 2*a*2 having the same shape as that of the outer peripheral surface of the outer cylinder section 40*b* of the insulating plug 40. A positioning pin receiving surface 2*d* for receiving a pair of left and right positioning pins 40*i* formed in the outer cylinder section 40*b* of the insulating plug 40 is formed on both left and right sides of the semicylindrical concave section 2*a*2.

A portion between the semicylindrical concave section 2*a*1 and the semicylindrical concave section 2*a*2 in the upper end face 2*a* of the insertion amount regulating jig 2 is formed like a step and a vertical surface 2*b* in a portion positioned in a lowermost stage defines the position of the optical reference plane Po of the insulating plug unit 14. Moreover, the front end face 2*c* of the insertion amount regulating jig 2 is formed to be positioned at a distance Lo from the vertical surface 2*b*. The distance Lo is a set dimension from the optical reference plane Po in the discharge bulb 10 to the tip position of the bar-shaped electrode 26B on the rear side of the arc tube unit 12 (the predetermined position of the discharge light emitting section 16*a*).

In order to regulate the amount of the insertion of the arc tube unit 12 in the glass tube 50, first of all, a discharge bulb intermediate process product 10' obtained immediately after the base end 12*a* of the arc tube unit 12 is inserted in the glass tube 50 is set to the insertion amount regulating jig 2 such that the optical axis Ax is horizontal as shown in FIG. 4(*a*). In this stage, the adhesive 54 applied to the inner peripheral surface of the glass tube 50 has not been solidified.

As shown in FIG. 4(*b*), next, the insulating plug unit 14 of the discharge bulb intermediate process product 10' set to the insertion amount regulating jig 2 is lightly pushed forward to cause the spherical projection 40*j* positioned on the lower end of the ring section 40*f* of the insulating plug 40 to abut on the vertical surface 2*b* of the insertion amount regulating jig 2. In this state, the arc tube unit 12 is moved in a longitudinal direction to regulate the amount of the insertion of the arc tube unit 12 in the glass tube 50.

The amount of the insertion is regulated in order to cause a dimension L between the optical reference plane Po and the tip position of the bar-shaped electrode 26B in the discharge bulb intermediate process product 10' to be coincident with the set dimension Lo. More specifically, the regulation is carried out by causing the tip position of the bar-shaped electrode 26B to be coincident with the front end face 2*c* of the insertion amount regulating jig 2*c* by viewing.

As described above in detail, in the discharge bulb 10 according to the embodiment, the glass tube 50 is fixed to the insulating plug unit 14, the base end 12*a* of the arc tube unit 12 is inserted in the glass tube 50, and the shroud tube 18 of the arc tube unit 12 and the glass tube 50 are bonded and fixed to each other. Therefore, the arc tube unit 12 can be fixed and supported on the insulating plug unit 14 with a simple structure, and it is possible to eliminate a possibility that the shroud tube 18 might be damaged, for example, broken by the fastening force of the metal band as in the conventional art.

In the embodiment, moreover, when the discharge bulb 10 is to be manufactured, the base end 12*a* of the arc tube unit 12 is inserted in the glass tube 50 which is previously fixed to the insulating plug unit 14 and the shroud tube 18 and the glass tube 50 are then bonded and fixed to each other in such a state that the dimension L between the optical reference plane Po of the insulating plug unit 14 and the tip position of the bar-shaped electrode 26B of the arc tube 16 is the set dimension Lo. Therefore, the arc tube unit 12 can be fixed and supported on the insulating plug unit 14 in a simple process, and it is possible to eliminate a possibility that the shroud tube 18 might be damaged, for example, broken by the fastening force of the metal band as in the conventional art.

In addition, as in the embodiment, the shroud tube 18 and the glass tube 50 are bonded and fixed to each other so that the arc tube unit 12 can be supported over a comparatively large cylindrical surface. Also in the case in which a vibration load and an impact load act on the discharge bulb 10, therefore, it is possible to effectively prevent the shroud tube 18 from being damaged.

In the embodiment, moreover, the glass tube 50 is formed of aluminosilicate having an ultraviolet absorbing property. Therefore, the ultraviolet rays leaking out of the base end 20*b* of the arc tube body 20 which is not surrounded by the shroud tube 18 can be absorbed into the glass tube 50. Consequently, it is possible to effectively prevent the insulating plug unit 14 from being deteriorated by the irradiation of the ultraviolet rays leaking out of the base end 20*b* of the arc tube body 20.

In the embodiment, when the shroud tube 18 is to be bonded and fixed to the glass tube 50, the adhesive 54 is applied to the inner peripheral surface of the glass tube 50 and the base end 12*a* of the arc tube unit 12 is then inserted in the glass tube 50 to regulate the amount of the insertion. Instead, the base end 12*a* of the arc tube unit 12 is inserted in the glass tube 50 and the amount of the insertion is regulated, and the adhesive 54 is then injected between the glass tube 50 and the shroud tube 18 from the front end face of the glass tube 50. Consequently, it is also possible to bond and fix the shroud tube 18 to the glass tube 50.

In the discharge bulb 10 according to the embodiment, the set dimension Lo between the optical reference plane Po and the tip position of the bar-shaped electrode 26B is set to have a proper value which is different from an original value. Consequently, the discharge bulb 10 can also be used for a lighting tool (a headlamp for a vehicle) to which a so-called HB4 type halogen bulb is attached in place of the halogen bulb 10. This respect will be described below in detail.

Figure 5:
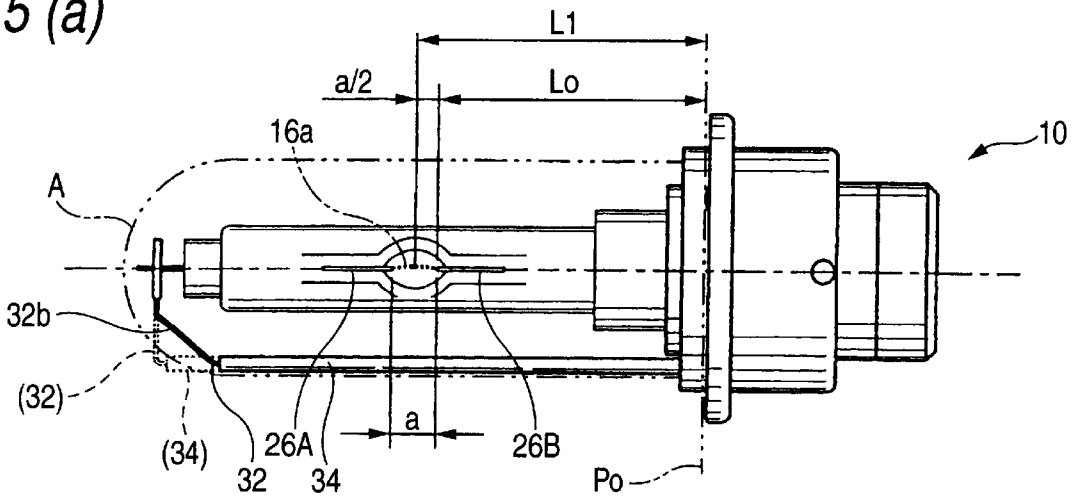
Figure 5:
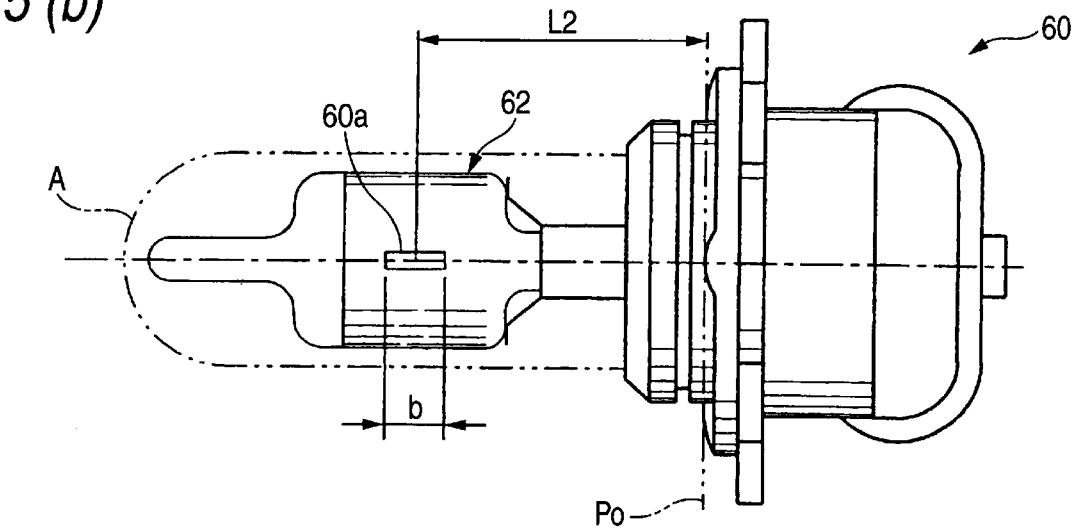
Figure 6:
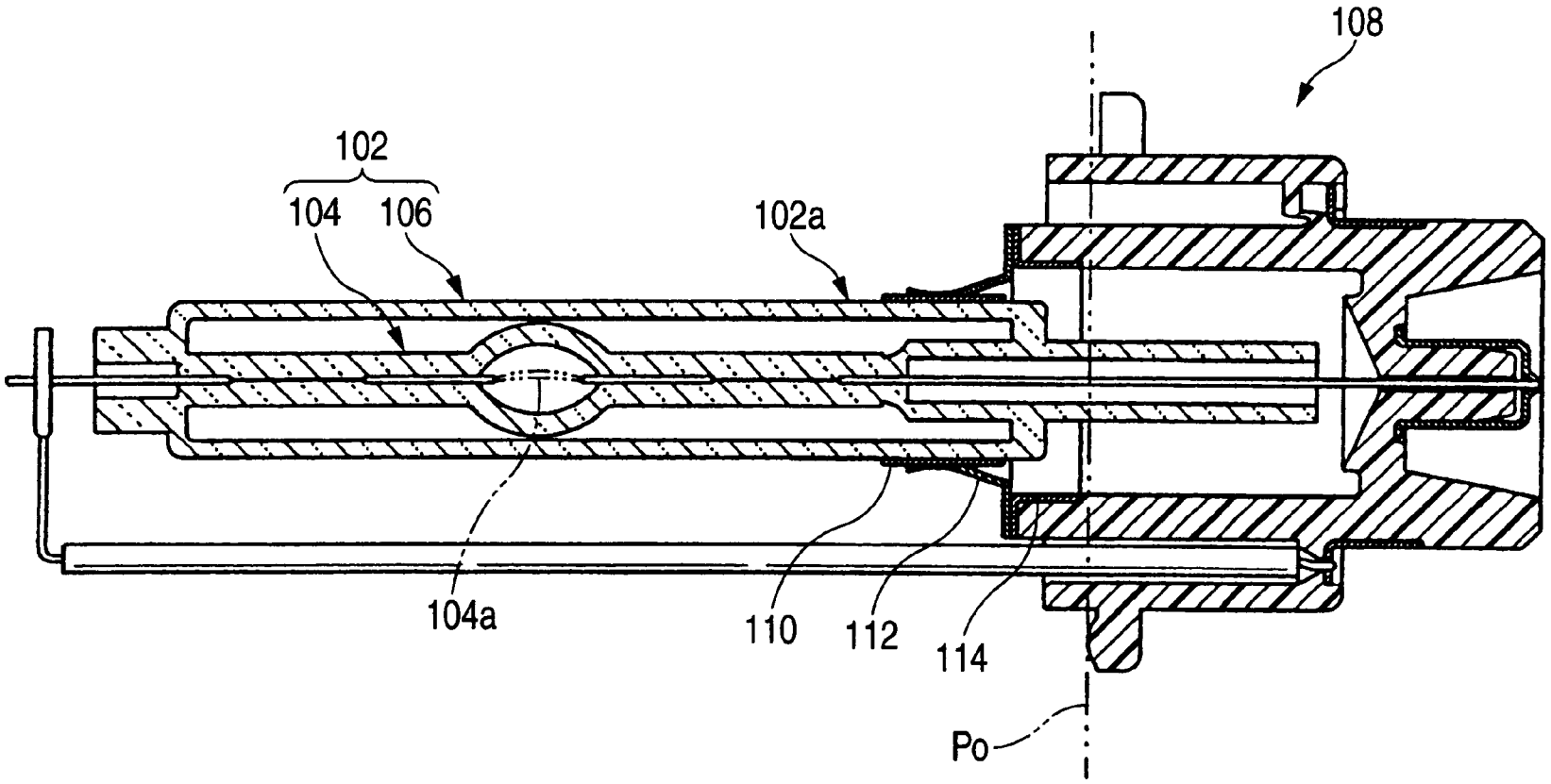
PRIOR ART FIG. 6

FIG. 5 is a side view showing the discharge bulb 10 and a halogen bulb 60 of an HB4 type which are arranged.

As shown in FIG. 5(*a*), by setting a dimension L1 between the optical reference plane Po in the discharge bulb 10 and a central position between the bar-shaped electrodes 26A and 26B (the central position of the discharge light emitting section 16*a*) to have a value which is equal to a dimension L2 between the optical reference plane Po in the halogen bulb 60 shown in FIG. 5(*b*) and the central position of a filament 60*a* (L1=L2), it is possible to obtain an almost equivalent light distribution pattern even if the discharge bulb 10 is used for the lighting tool to which the halogen bulb 60 is attached in place of the halogen bulb 60. At this time, the central position between the bar-shaped electrodes 26A and 26B and the central position of the filament 60*a* are employed because a space a between the bar-shaped electrodes 26A and 26B in the discharge bulb 10 and a length b of the filament 60*a* are slightly different from each other (a<b).

In order to cause the halogen bulb 60 and the discharge bulb 10 to have a compatibility (that is, in order to set L1=L2), it is preferable that the set dimension Lo between the optical reference plane Po in the discharge bulb 10 and the tip position of the bar-shaped electrode 26B is set to be Lo=L2−a/2.

In FIG. 5(*b*), a region A surrounding a glass tube section 62 of the halogen bulb 60 to take the shape of an almost test tube (a region shown in a two-dotted chain line) is maintained to be a space for exclusive use in the halogen bulb 60 when the halogen bulb 60 is attached to a lighting tool, and there is a possibility that a structure such as a shade might be present on the outside of the region A.

In this respect, in the discharge bulb 10 according to the embodiment, the portion 32*b* in the vicinity of the front end of the lead wire 32 is extended to be chamfered obliquely upward. Therefore, an occupied space can be more reduced than that in a conventional discharge bulb. More specifically, while a part of the lead wire 32 and the sleeve 34 is protruded from the region A shown in the two-dotted chain line in the conventional discharge bulb as shown in a broken line of FIG. 5(*a*), they can be prevented from being protruded from the region A in the discharge bulb 10.

As shown in the structure, in the discharge bulb according to the invention, the glass tube is fixed to the plug member, the base end of the arc tube unit is inserted in the glass tube, and the shroud tube of the arc tube unit and the glass tube are bonded and fixed to each other. Therefore, the arc tube unit can be fixed and supported on the plug member with a simple structure, and it is possible to eliminate a possibility that the shroud tube might be damaged, for example, broken by the fastening force of the metal band as in the conventional art.

In the method of manufacturing a discharge bulb according to the invention, moreover, the base end of the arc tube unit is inserted in the glass tube which is previously fixed to the plug member, and the shroud tube and the glass tube are then bonded and fixed to each other in such a state that the amount of insertion of the arc tube unit is regulated in order to set the dimension between the optical reference plane of the plug member and the predetermined position of the discharge light emitting section of the arc tube to be the predetermined set dimension. Therefore, the arc tube unit can be fixed and supported on the plug member in a simple process, and it is possible to eliminate a possibility that the shroud tube might be damaged, for example, broken by the fastening force of the metal band as in the conventional art.

In addition, as in the invention, the shroud tube and the glass tube are bonded and fixed to each other so that the arc tube unit can be supported on a comparatively large cylindrical plane. Also in the case in which a vibration load or an impact load acts on the discharge bulb, therefore, it is possible to effectively prevent the shroud tube from being broken.

In the invention, the material of the glass tube is not particularly restricted as described above. If an ultraviolet absorbing material is used, the following functions and effects can be obtained.

More specifically, in the arc tube unit, the ultraviolet absorbing material is generally used as the material of the shroud tube in order not to irradiate ultraviolet rays on the outside. Also in this case, the ultraviolet rays slightly leak out of the base end of the arc tube which is not surrounded by the shroud tube. There is a problem in that the plug member is apt to be deteriorated if the leaking ultraviolet rays are irradiated on the plug member. If the ultraviolet absorbing material is used for the material of the glass tube, it is possible to effectively prevent the ultraviolet rays leaking out of the base end of the arc tube from being irradiated on the plug member, resulting in a deterioration in the plug member.

While the specific composition of the "ultraviolet absorbing material" is not particularly restricted, it is possible to employ hard glass such as aluminosilicate and quartz glass doped with an ultraviolet absorbent.

As a matter of course, the "glass tube" may be colorless and clear or may have a proper color (for example, blue, yellow or black). In such a case, the luminescent color of the discharge bulb is not influenced but the design of the discharge bulb can have a novelty.

What is claimed is:

1. A discharge bulb comprising an arc tube unit including an arc tube and a shroud tube cylindrically surrounding the arc tube, and a plug member for fixing and supporting a base end of the arc tube unit, wherein a glass tube is fixed to the plug member, the base end of the arc tube unit is inserted in the glass tube and the shroud tube of the arc tube unit and the glass tube are bonded and fixed to each other;

wherein the outer diameter of the shroud tube substantially matches the inner diameter of the glass tube so that the shroud tube can be slidably received within the glass tube; and wherein the shroud tube has a constant outer diameter at least over a portion that is bonded and fixed to the glass tube.

2. The discharge bulb according to claim 1, wherein an ultraviolet absorbing material is used for a material of the glass tube.

3. A method of manufacturing a discharge bulb comprising an arc tube unit including an arc tube and a shroud tube cylindrically surrounding the arc tube, and a plug member for fixing and supporting a base end of the arc tube unit, comprising the steps of:

inserting the base end of the arc tube unit in a glass tube which is previously fixed to the plug member;

using a regulating jig to regulate the amount of insertion; and bonding and fixing the shroud tube and the glass tube to each other in such a state that an amount of insertion of the arc tube unit is regulated by the regulating jig in order to set a dimension between an optical reference plane of the plug member and a predetermined position of a discharge light emitting section of the arc tube to be a predetermined set dimension wherein the outer diameter of the shroud tube substantially matches the inner diameter of the glass tube so that the shroud tube can be slidably received within the glass tube; and wherein the shroud tube has a constant outer diameter at least over a portion that is bonded and fixed to the glass tube.

* * * * *